United States Patent [19]

Wellenkotter et al.

[11] Patent Number: 5,007,396

[45] Date of Patent: Apr. 16, 1991

[54] THROTTLE VALVE ADJUSTMENT CONSTRUCTION, THROTTLE VALVE ADJUSTMENT UNIT THEREFOR AND METHODS OF MAKING THE SAME

[75] Inventors: Carl A. Wellenkotter, Rochester, Mich.; David E. Counts, Louisville, Tenn.

[73] Assignee: Robertshaw Controls Company, Richmond, Va.

[21] Appl. No.: 434,231

[22] Filed: Nov. 13, 1989

[51] Int. Cl.[5] ..... F02M 3/05

[52] U.S. Cl. ..... 123/339

[58] Field of Search ..... 123/339, 376, 395; 236/99 K, 100

[56] References Cited

U.S. PATENT DOCUMENTS

| | | | |
|---|---|---|---|
| 1,838,408 | 12/1931 | King et al. | 123/334 |
| 2,906,253 | 9/1959 | Nallinger | 123/339 |
| 3,719,085 | 3/1973 | Sliger | 60/527 |
| 3,800,759 | 4/1974 | Cedar | 123/339 |
| 4,250,709 | 2/1981 | Conrad et al. | 123/339 |
| 4,449,499 | 5/1984 | Ito | 123/339 |
| 4,548,354 | 10/1985 | Wagner et al. | 236/100 |

*Primary Examiner*—Tony M. Argenbright
*Assistant Examiner*—Robert E. Mates
*Attorney, Agent, or Firm*—Candor Candor & Tassone

[57] ABSTRACT

A throttle valve adjustment construction, a throttle valve adjustment unit and methods of making the same are provided, the throttle valve adjustment construction comprising a support, a throttle valve adjustment arm movably carried by the support and having structure for tending to move the arm in one direction to a closed throttle condition thereof, and a temperature operated throttle valve adjustment unit carried by the support and being operatively associated with the arm to adjust the position of the arm at the throttle closed condition thereof, the throttle valve ajustment unit comprising a temperature responsive device that comprises a piston member and a cylinder member that are adapted to provide relative movement therebetween when the device senses certain temperatures.

12 Claims, 2 Drawing Sheets

THROTTLE VALVE ADJUSTMENT CONSTRUCTION, THROTTLE VALVE ADJUSTMENT UNIT THEREFOR AND METHODS OF MAKING THE SAME

BACKGROUND OF THE INVENTION

1. Field of the Invention

This invention relates to a new throttle valve adjustment construction and to a new throttle valve adjustment means therefor as well as to new methods of respectively making such a throttle valve adjustment construction and such a throttle valve adjustment means.

2. Prior Art Statement

It is known to provide a throttle valve adjustment construction comprising a support means, a throttle valve adjustment arm movably carried by the support means and having moving means for tending to move the arm in one direction to a closed throttle condition thereof, and a temperature operated throttle valve adjustment means carried by the support means and being operatively associated with the arm to adjust the position of the arm at the throttle closed condition thereof, the temperature operated throttle valve adjustment means comprising a bimetallic spring or diaphragm.

SUMMARY OF THE INVENTION

It is one feature of this invention to provide a new throttle valve adjustment construction wherein the temperature operated throttle valve adjustment means comprises a conventional piston and cylinder temperature responsive device.

In particular, it was found according to the teachings of this invention that a piston and cylinder temperature responsive device of a type that is normally utilized to control the position of a poppet valve in a vehicle coolant system can be utilized to adjust the position of a throttle valve adjustment arm when the throttle valve is in a closed condition thereof and when the device has been made to operate in a certain temperature range thereof.

For example, one embodiment of this invention provides a throttle valve adjustment construction comprising a support means, a throttle valve adjustment arm movably carried by the support means and having moving means for tending to move the arm in one direction to a closed throttle condition thereof, and a temperature operated throttle valve adjustment means carried by the support means and being operatively associated with the arm to adjust the position of the arm at the throttle closed condition thereof, the throttle valve adjustment means comprising a temperature responsive device that comprises a piston member and a cylinder member that are adapted to provide relative movement therebetween when the device senses certain temperatures.

Accordingly, it is an object of this invention to provide a new throttle valve adjustment construction having one or more of the novel features of this invention as set forth above or hereinafter shown or described.

Another object of this invention is to provide a new method of making such a throttle valve adjustment construction, the method of this invention having one or more of the novel features of this invention as set forth above or hereinafter shown or described.

Another object of this invention is to provide a new temperature operated throttle valve adjustment means having one or more of the novel features of this invention as set forth above or hereinafter shown or described.

Another object of this invention is to provide a new method of making such a temperature operated throttle valve adjustment means, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
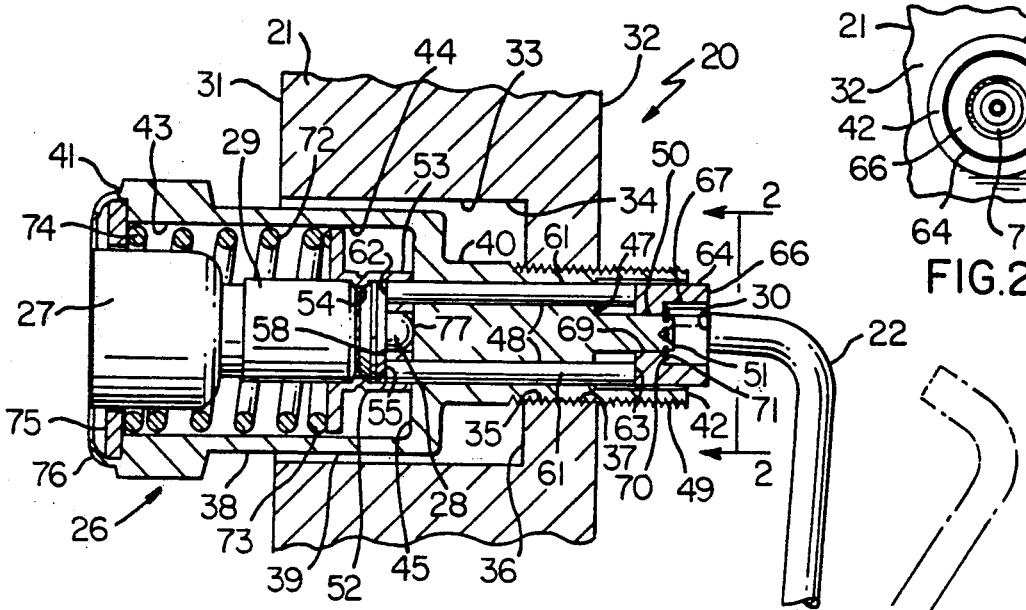
FIG. 1 is a fragmentary cross-sectional view illustrating the new throttle valve adjustment construction of this invention, the throttle valve adjustment arm being shown in full lines in a closed throttle condition thereof with the temperature operated throttle valve adjustment means of this invention in one operating condition thereof and the throttle valve adjustment arm being shown in dotted lines in the normal increased condition thereof during normal engine operation.
Figure 2:
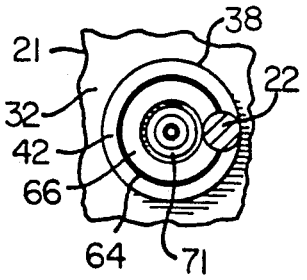
FIG. 2 is a fragmentary cross-sectional view taken on line 2—2 of FIG. 1.

While the various features of this invention are hereinafter described and illustrated as being particularly adapted to provide a temperature operated throttle valve adjustment means for a particular throttle valve adjustment arm arrangement, it is to be understood that the various features of this invention can be utilized singly or in various combinations thereof to provide a temperature operated throttle valve adjustment means for other constructions as desired.

Therefore, this invention is not to be limited to only the embodiment illustrated in the drawings, because the drawings are merely utilized to illustrate one of the wide variety of uses of this invention.

Referring now to FIGS. 1–4, the new throttle valve adjustment construction of this invention is generally indicated by the reference numeral 20 and comprises a support means 21, such as a throttle valve housing of an internal combustion engine (not shown) of a transportation vehicle (not shown) or the like, a throttle valve adjustment arm 22 movably carried by the support means, such as by being interconnected to a throttle valve adjustment member 23 pivotally mounted to the support means 21 by a pivot means 24 and normally being urged in a counterclockwise direction by a moving means or compression spring 25, and a temperature operated throttle valve adjustment means of this invention that is generally indicated by the reference numeral 26 and being operatively associated with the arm 22 to adjust the position of the arm 22 at the throttle closed condition thereof, the throttle valve adjustment means comprising a temperature responsive device 27 that comprises a piston member 28 and a cylinder member 29 that are adapted to provide relative movement therebetween when the device 27 senses certain temperatures as will be apparent hereinafter.

Figure 3:
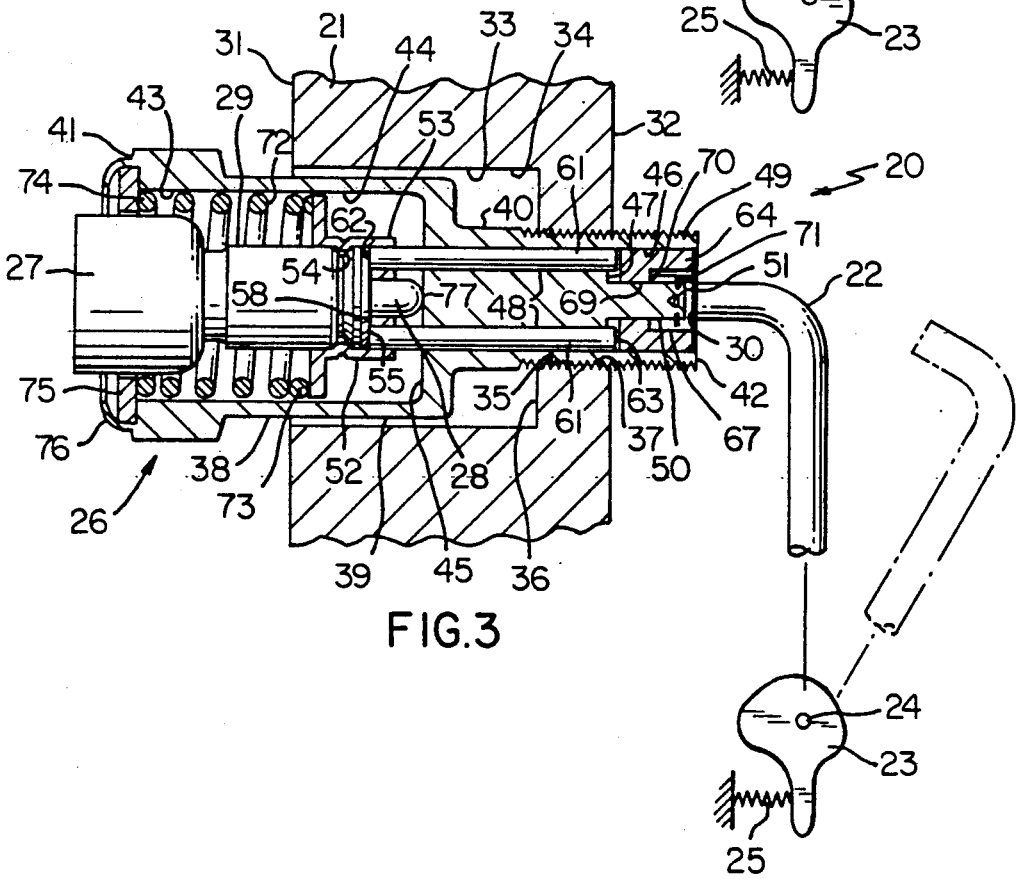
FIG. 3 is a view similar to FIG. 1 and illustrates the temperature operated throttle valve adjustment means of this invention in another operating condition thereof.
Figure 4:
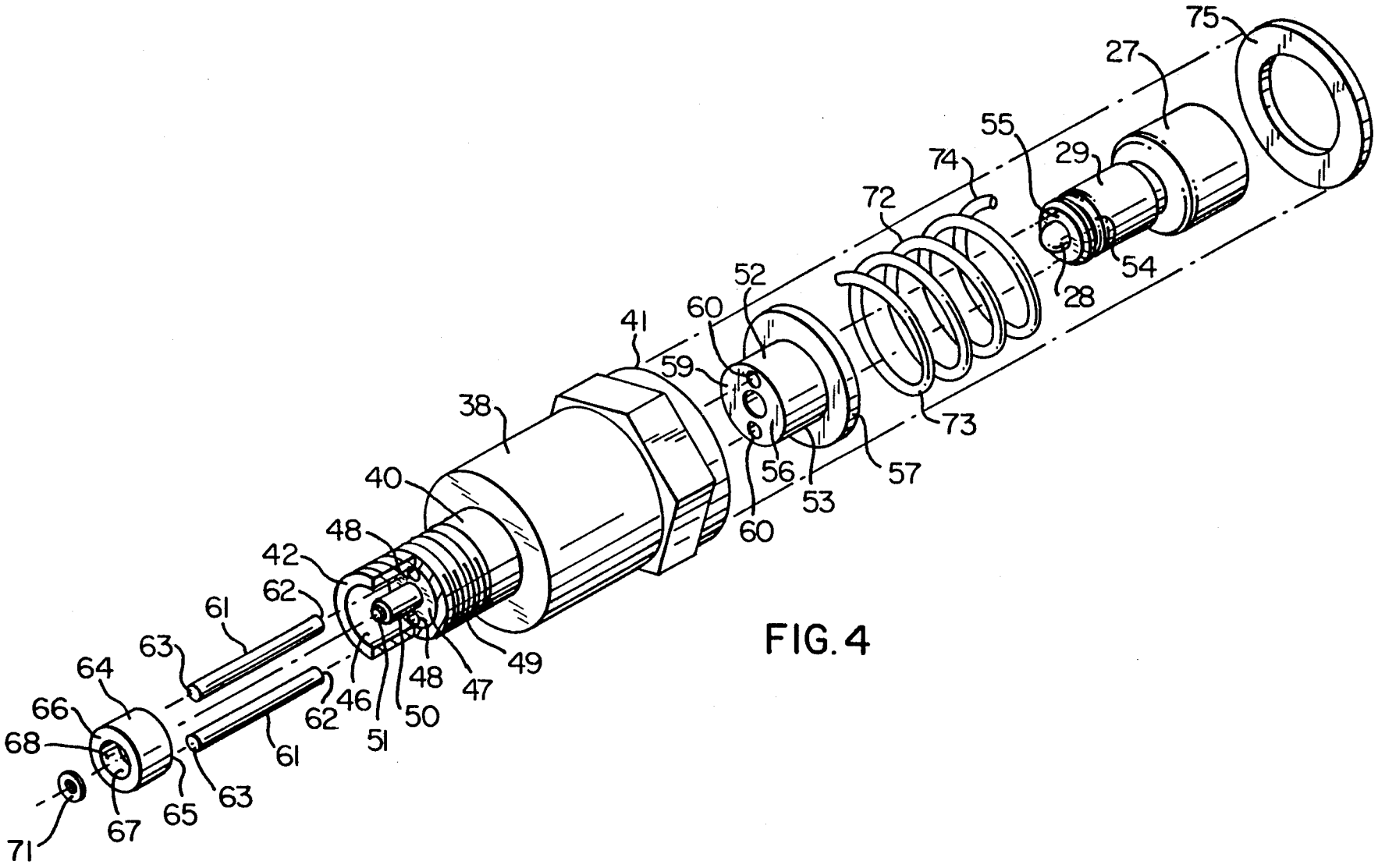
FIG. 4 is an exploded perspective view of the temperature operated throttle valve adjustment means of this invention that is utilized in the construction of FIGS. 1–3.

It is well known in the art that a throttle body injection unit's throttle arm displacement at a low temperature and a closed throttle condition must be in an increased direction, such as to right in FIG. 1, than when at a higher temperature and a closed throttle condition, such as by being set more to left in FIG. 3, while permitting the throttle arm to be freely movable to a further increased displacement condition thereof, such as illustrated by dotted lines in FIGS. 1 and 3, when the vehicle engine is being normally operated.

For example, when the device 27 of the construction 20 of this invention is sensing a temperature of approximately 35° F. or lower, the piston 28 is in its fully retracted condition in the cylinder 29 as illustrated in FIG. 1 and when the device 27 is sensing a temperature of approximately 55° F. or higher, the piston 28 is in its fully extended condition as illustrated in FIG. 3 wherein it can be seen that an end 30 of the arm 22 is in its furthest position of displacement to the right in FIG. 1 when the device 27 is sensing a temperature of 35° F. or below and is in its least position of displacement to the right in FIG. 3 when the device 27 is sensing a temperature of approximately 55° F. or higher.

Since the temperature adjustment of a throttle arm to various positions at the throttle valve closed condition thereof is well known in the art as the throttle arm has been adjusted to various positions by prior known temperature operated throttle valve adjustment means that comprise either a bimetallic spring or diaphragm, the details of the structure and the operation of a throttle valve and its adjustment arm need not be further set forth.

Therefore, only the details of the structure and the operation of the temperature operated throttle valve adjustment means 26 of this invention in combination with the arm 22 and the support means 21 will now be described.

The support means 21 for carrying the temperature operated throttle valve adjustment means 26 is formed of any suitable material, such as metallic material, and has opposed walls 31 and 32 that are respectively interrupted by a stepped opening 33 that defines a larger cylindrical section 34 separated from a smaller cylindrical section 35 of the opening 33 by an internal shoulder or wall 36, the smaller cylindrical section 35 of the opening 33 being internally threaded to define internal threads 37 for a purpose hereinafter set forth.

The temperature operated throttle valve adjustment means 26 comprises a housing means or member 38 formed of any suitable material, such as metallic material, that has a larger cylindrical section 39 integrally interconnected to a smaller cylindrical section 40 thereof and having opposed ends 41 and 42, the end 41 being interrupted by an opening means 43 that defines a large cylindrical internal section 44 of the opening means 43 that terminates at an end wall or stop surface 45 in the housing member 38. The other end wall 42 of the housing member 38 is interrupted by an opening 46 that terminates at an internal end wall 47 as illustrated. A pair of cylindrical openings 48 respectively interrupt the end walls 45 and 47 in the smaller cylindrical section 40 of the housing member 38 to interconnect the openings 43 and 46 together for a purpose hereinafter described.

The smaller cylindrical section 40 of the housing member 38 is externally threaded to define external threads 49 which permits the housing member 38 to be threaded into the internally threaded section 35 of the opening 33 of the support means 21 so as to interconnect the temperature operated throttle valve adjustment means 26 thereto as well as to provide an adjustment or calibration means therebetween as will be apparent hereinafter.

The opening 46 in the end wall 42 of the housing member 38 defines a central reduced stem 50 that extends from the center of the internal end wall 47 and terminates at an end 51 thereof that is disposed short of the end wall 42 of the housing 38.

The temperature responsive device 27 is of a type that is well known in the art and contains a temperature responsive means, such as a wax charge, disposed in the cylinder member 29 which contracts to a certain condition thereof when the same is at a certain temperature or below and will expand to a certain condition thereof when at a certain higher temperature or higher so as to tend to extend the piston 28 out of the cylinder 29 to a certain position thereof. For example, see the Sliger U.S. Pat. No. 3,719,085, and the Wagner et al, U.S. Pat. No. 4,548,354, whereby these two patent are being incorporated into this disclosure by this reference thereto.

Therefore, since the details of the structure and the operation of a temperature responsive device of the piston and cylinder type is well known in the art, a further discussion of the structure and operation thereof need not be set forth.

A metallic spring retainer or collar 52 is carried by the cylinder member 29 in any suitable manner, such as by having a portion of a tubular part 53 of the spring retainer 52 inwardly deformed into an annular groove 54 formed in the cylinder member 29 adjacent an end wall 55 thereof as illustrated.

The tubular portion 53 of the spring retainer 52 has a disc-like part 56 at one end thereof and an outwardly directed annular flange 57 at the other end thereof, the disc-like part 56 having opposed parallel and flat surfaces 58 and 59 with the surface 58 thereof being held against the end surface 55 of the cylinder member 29 at the time that the spring retainer 52 is fastened to the cylinder member 29.

The disc end 56 of the spring retainer 52 has a pair of openings 60 interrupting the opposed surfaces 58 and 59 thereof and being respectively disposed in alignment with the openings 48 through the housing member 38 so that a pair of metallic pins or rods 61 can be respectively disposed in the aligned openings 48 and 60 and have the ends 62 thereof abut against the end wall 55 of the cylinder member 29 and have the other ends 63 thereof project outwardly beyond the end wall 47 of the housing member 38 as illustrated.

A cylindrical stop member 64 formed of any suitable material, such as metallic material, has opposed parallel and flat end surfaces 65 and 66 that are respectively interrupted by a stepped opening 67 that defines a larger cylindrical internal section 68 at the end wall 66 and a smaller cylindrical internal section 69 at the end wall 65 thereof and being joined together by an annular internal shoulder 70 as illustrated. In this manner, the movable stop member 64 is telescoped onto the stem 50 of the housing member 38 by having the stem 50 project through the smaller opening section 69 and have a disc-like retainer 71 staked or otherwise secured to the free end 51 of the stem 50 so as to be engaged by the annular shoulder 70 to prevent the stop member 64 from moving further to the right from its most right position as illustrated in FIG. 1.

A compression spring 72 is disposed in the opening 43 of the housing member 68 and has one end 73 bearing against the annular flange 57 of the spring retainer 52 and another end 74 bearing against an annular washer-like member 75 secured to the end 41 of the housing member 38 by a portion thereof that is turned over at 76 as illustrated.

In this manner, the force of the compression spring 72 tends to move the cylinder member 29 to the right in the drawings and force the free end 77 of the piston member 28 against the end wall 45 of the housing member 38 in all operating positions of the throttle valve adjusting means 26 as will be apparent hereinafter.

Also, the force of the compression spring 72 in tending to move the cylinder member 29 to the right in the drawings tends to move the rods or pins 61 to the right and thus through their interconnection with the end wall 55 of the cylinder member 29 and their engagement against the end wall 65 of the movable stop 64, tends to move the movable stop 64 to the right. Such movement of the stop member 64 to the right is terminated either by the stop member 64 contacting against the retainer 71 and/or the end wall 56 of the disc end 55 of the spring retainer 57 abutting against the end wall 45 of the housing member 38 as illustrated in FIG. 1.

However, when the temperature responsive device 27 is sensing a certain temperature that causes the wax charge therein to expand and because the piston member 28 is disposed against the end wall 45 of the housing 38, such expansion causes the cylinder member 29 to move to the left in the drawings in opposition to the force of the compression spring 72 and thereby permit the pins 61 and stop member 64 to move to the left therewith under the force of the moving means or compression spring 25 tending to pivot the arm 22 and move the end 30 thereof to the left to the position illustrated in FIG. 3.

If desired, the end 30 of the arm 22 can be so arranged in the construction 20 that the arm 22 will have the end 30 thereof bottom out against the end surface 42 of the housing member 38 should the movable stop member 64 have its end surface 66 move to the left beyond the end surface 42 of the housing member 38 in the manner illustrated in FIG. 3 so that a precise positioning of the end 30 of the arm 22 will be provided by the adjustment means 26 of this invention as will be apparent hereinafter.

Thereafter, should the temperature being sensed by the device 26 fall to the temperature that causes the wax charge therein to contract, the force of the compression spring 72 moves the cylinder member 29 to the right and carries the pins 61 therewith to position the stop member 64 further to the right until the same is moved to its most rightward position as illustrated in FIG. 1.

Of course, it is to be understood that the stop member 64 will be positioned anywhere intermediate the two extreme positions illustrated in FIGS. 1 and 3 thereof depending upon the temperature being sensed by the device 26 as the case may be.

Therefore, it can be seen that it is a relatively simple method of this invention to make the temperature operated throttle valve adjustment means 26 of this invention to be assembled with the support means 21 and arm 22 to make the throttle valve adjustment construction 20 of this invention that operates in a manner now to be described.

The temperature operated throttle valve adjustment means 26 of this invention is mounted in the opening 33 of the support means 21 by threading the housing section 40 in the threaded opening 35 of the support means 21 in a manner to position the end 42 of the housing 38 at a proper position relative to the end 30 of the arm 22 so that with the temperature responsive device 27 sensing a temperature below a certain temperature, such as the aforementioned 35° F., the piston member 28 is in its fully contracted condition in the cylinder member 29 so that the force of the compression spring 72 maintains the cylinder member 29 to its full right position as illustrated in FIG. 1 and through the pins or rods 61 holds the movable stop member 64 to its full right position against the retainer 71 as illutrated in FIG. 1 so that the arm 22 is in the adjustment position illustrated in FIG. 1 when the throttle valve is in a closed condition thereof.

In this manner, it can be seen that the throttle arm 22 is free to move away from the stop member 64 during the normal operation of the vehicle wherein the arm 22 would be in the phantom line position illustrated in FIGS. 1 and 3 and then be permitted to return toward the temperature operated throttle valve adjustment means 26 of this invention under the urging of the moving means or spring 25 when a closed throttle condition exists.

However, as the ambient temperature surrounding the temperature responsive device 27 increases to about 55° F., the wax charge in the cylinder member 29 expands and thereby causes the end 77 of the piston 28 to fully bear against the end wall 45 of the support means 21 and thereby force the cylinder member 29 to the left in opposition to the force of the compression spring 72 whereby the end 30 of the arm 22 is moved to the left under the force of the moving means or compression spring 25 to move the movable stop member 64 and pins or rods 61 to the left to follow the movement of the cylinder member 29 to the left as illustrated in FIG. 3 whereby it can be seen that the position of the throttle arm 22 in its throttle closed condition is now in a different adjusted position than when the temperature responsive device 27 was in its cold condition as illustrated in FIG. 1.

As previously stated, should the movement of the cylinder member 29 to the left carry the stop member 64 therewith so that the surface 66 of the stop member 64 moves further to the left beyond the end surface 42 of the housing member 38, the end 30 of the rod 22 will remain abutted against the surface 42 of the housing member 38 as illustrated in FIG. 3.

In this manner, it can be seen that it is relatively easy to predetermine the cold set condition of the arm 22 as illustrated in FIG. 1 and the warmer temperature set condition thereof as illustrated in FIG. 3 by determining the amount of projection of the surface 66 of the movable stop member 64 that will be permitted to extend beyond the surface 42 of the housing member 38 in the cold condition illustrated in FIG. 1 wherein the movement of the cylinder member 29 to the right under the force of the compression spring 72 is limited by the collar means 53 bottoming out against the stop surface 45 of the housing means 38 or the surface 70 of the stop member 64 engaging the retainer 71 whereas in the warmer temperature condition of the temperature responsive device 27, the position of the arm 22 is determined by the end 30 of the arm 22 moving from the position illustrated in FIG. 1 to the position illustrated in FIG. 3 wherein the arm 22 bottoms out against the surface 42 of the housing member 38.

In one working embodiment of this invention, the amount of movement of the end 30 of the arm 22 between the cold condition of FIG. 1 and the warmer condition of FIG. 3 is approximately 0.080 of an inch.

However, it is to be understood that this invention is not to be limited to any stroke distance and to any particular temperatures for setting the position of the arm 22 as the above dimensions and temperatures are only given as one working embodiment thereof.

From the above, it can be seen that by adjusting the initial threaded relation between the throttle valve adjustment means 26 and the support means 21, the cold set position of the arm 22 can be adjusted or calibrated and the warmer temperature set position thereof will likewise be adjusted therewith. Also, by selecting the particular wax charge for the device 27, the desired cold temperature and the desired warmer temperature for the two extreme setting positions for the throttle arm 22 can be provided.

Therefore, it can be seen that this invention not only provides a new throttle valve adjustment construction and a new temperature operated throttle valve adjustment means therefor, but also this invention provides new methods of making such a throttle valve adjustment construction and such a temperature operated throttle valve adjustment means.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a throttle valve adjustment construction comprising a support means, a throttle valve adjustment arm movably carried by said support means and having moving means for tending to move said arm in one direction to a closed throttle condition thereof, and a temperature operated throttle valve adjustment means carried by said support means and being operatively associated with said arm to adjust the position of said arm at said throttle closed condition thereof, said throttle valve adjustment means comprising a temperature responsive device that comprises a piston member and a cylinder member that are adapted to provide relative movement therebetween when said device senses certain temperatures, said throttle valve adjustment means having a movable stop member operatively associated with said temperature responsive device to be positioned thereby in various positions thereof in relation to the temperature being sensed by said device, said adjustment arm being adapted to be moved by said moving means into abutting relation with said stop member in said various positions thereof when said arm is in said throttle closed condition thereof, said throttle valve adjustment means comprising a housing means carrying said temperature responsive device and said movable stop member, said support means carrying said housing means, the improvement wherein said housing means has a stop surface against which said arm is adapted to abut when said arm is in said throttle closed condition thereof and said temperature responsive device has moved said movable stop member in one direction beyond a certain position thereof.

2. A construction as set forth in claim 1 wherein said temperature responsive device positions said movable stop member beyond said certain position in the other direction that is opposite to said one direction so as to be abutted by said arm when said arm is in said throttle closed condition thereof and said temperature responsive device is sensing a lower temperature than the temperature that causes said device to move said stop member in said one direction beyond said certain position thereof.

3. In a throttle valve adjustment construction comprising a support means, a throttle valve adjustment arm movably carried by said support means and having moving means for tending to move said arm in one direction to a closed throttle condition thereof, and a temperature operated throttle valve adjustment means carried by said support means and being operatively associated with said arm to adjust the position of said arm at said throttle closed condition thereof, said throttle valve adjustment means comprising a temperature responsive device that comprises a piston member and a cylinder member that are adapted to provide relative movement therebetween when said device senses certain temperatures, said throttle valve adjustment means having a movable stop member operatively associated with said temperature responsive device to be positioned thereby in various positions thereof in relation to the temperature being sensed by said device, said adjustment arm being adapted to be moved by said moving means into abutting relation with said stop member in said various positions thereof when said arm is in said throttle closed condition thereof, said throttle valve adjustment means comprising a housing means carrying said temperature responsive device and said movable stop member, said support means carrying said housing means, the improvement wherein said housing means has a stop wall, said throttle valve adjustment means comprising spring means carried by said housing means and being operatively interconnected to said cylinder member to tend to move said cylinder member toward said stop wall whereby said spring means tends to hold said piston member against said stop wall by the force of said spring means, said housing means having opening means passing through said stop wall, said throttle valve adjustment means comprising pin means disposed in said opening means and having opposed end means respectively extending out of said opening means in opposite directions and respectively being engageable with said cylinder member and said movable stop member whereby said pin means position said stop member in relation to the position of said cylinder member relative to said stop wall.

4. A construction as set forth in claim 3, wherein said housing means has a stem projecting therefrom, said stop member having an opening passing therethrough and receiving said stem therethrough whereby said stop member is telescoped on said stem and is movable relative to said stem.

5. In a temperature operated throttle valve adjustment means for a throttle valve adjustment construction comprising a support means and a throttle valve adjustment arm movably carried by said support means and having moving means for tending to move said arm in one direction to a closed throttle condition thereof, said temperature operated throttle valve adjustment means being adapted to be carried by said support means and be operatively associated with said arm to adjust the position of said arm at said throttle closed condition thereof, said throttle valve adjustment means comprising a temperature responsive device that comprises a piston member and a cylinder member that are adapted to provide relative movement therebetween when said device senses certain temperatures, said throttle valve adjustment means having a movable stop member operatively associated with said temperature responsive device to be positioned thereby in various positions thereof in relation to the temperature being sensed by said device whereby said adjustment arm is adapted to be moved by said moving means into abutting relation with said stop member in said various positions thereof when said arm is in said throttle closed condition thereof, said throttle valve adjustment means comprising a housing means carrying said temperature responsive device and said movable stop member, the improvement wherein said housing means has a stop surface against which said arm is adapted to abut when said arm is in said throttle closed condition thereof and said temperature responsive device has moved said movable stop member in one direction beyond a certain position thereof.

6. A throttle valve means as set forth in claim 5 wherein said temperature responsive device positions said movable stop member beyond said certain position in the other direction that is opposite to said one direction so as to be adapted to be abutted by said arm when said arm is in said throttle closed condition thereof and said temperature responsive device is sensing a lower temperature than the temperature that causes said device to move said stop member in said one direction beyond said certain position thereof.

7. In a temperature operated throttle valve adjustment means for a throttle valve adjustment construction comprising a support means and a throttle valve adjustment arm movably carried by said support means and having moving means for tending to move said arm in one direction to a closed throttle condition thereof, said temperature operated throttle valve adjustment means being adapted to be carried by said support means and be operatively associated with said arm to adjust the position of said arm at said throttle closed condition thereof, said throttle valve adjustment means comprising a temperature responsive device that comprises a piston member and a cylinder member that are adapted to provide relative movement therebetween when said device senses certain temperatures, said throttle valve adjustment means having a movable stop member operatively associated with said temperature responsive device to be positioned thereby in various positions thereof in relation to the temperature being sensed by said device whereby said adjustment arm is adapted to be moved by said moving means into abutting relation with said stop member in said various positions thereof when said arm is in said throttle closed condition thereof, said throttle valve adjustment means comprising a housing means carrying said temperature responsive device and said movable stop member, the improvement wherein said housing means has a stop wall, said throttle valve adjustment means comprising spring means carried by said housing means and being operatively interconnected to said cylinder member to tend to move said cylinder member toward said stop wall whereby said spring means tends to hold said piston member against said stop wall by the force of said spring means, said housing means having opening means passing through said stop wall, said throttle valve adjustment means comprising pin means disposed in said opening means and having opposed end means respectively extending out of said opening means in opposite directions and respectively being engageable with said cylinder member and said movable stop member whereby said pin means position said stop member in relation to the position of said cylinder member relative to said stop wall.

8. A throttle valve adjustment means as set forth in claim 7 wherein said housing means has a stem projecting therefrom, said stop member having an opening passing therethrough and receiving said stem therethrough whereby said stop member is telescoped on said stem and is movable relative to said stem.

9. A construction as set forth in claim 1 wherein said throttle valve adjustment means has adjusting means for adjusting the position of said stop surface relative to said arm whereby the position where said arm is adapted to abut said stop surface can be adjusted.

10. A construction as set forth in claim 9 wherein said support means has an opening means therein that is internally threaded, said housing means having an externally threaded portion threaded in said internally threaded opening means whereby said support means carries said housing means by said threaded relation therebetween and said externally threaded portion comprises said adjusting means for said stop surface.

11. A throttle valve adjustment means as set forth in claim 5 wherein said throttle valve adjustment means has adjusting means for adjusting the position of said stop surface relative to said arm whereby the position where said arm is adapted to abut said stop surface can be adjusted.

12. A throttle valve adjustment means as set forth in claim 11 wherein said support means has an opening means therein that is internally threaded, said housing means having an externally threaded portion adapted to be threaded in said internally threaded opening means whereby said housing means is adapted to be carried by said support means by said threaded relation therebetween and said externally threaded portion comprises said adjusting means for said stop surface.

* * * * *